US012704293B2

(12) United States Patent
Yang et al.

(10) Patent No.: US 12,704,293 B2
(45) Date of Patent: Aug. 11, 2026

(54) HEAT GUN HAVING FLOW GUIDING ARRANGEMENT

(71) Applicant: ZHEJIANG PRULDE ELECTRIC APPLIANCE CO., LTD, Jinhua (CN)

(72) Inventors: Weiming Yang, Jinhua (CN); Yevhenii Shkvar, Jinhua (CN)

(73) Assignee: ZHEJIANG PRULDE ELECTRIC APPLIANCE CO., LTD, Jinhua (CN)

( * ) Notice: Subject to any disclaimer, the term of this patent is extended or adjusted under 35 U.S.C. 154(b) by 809 days.

(21) Appl. No.: 18/021,359

(22) PCT Filed: Aug. 17, 2021

(86) PCT No.: PCT/CN2021/113132
§ 371 (c)(1),
(2) Date: Feb. 14, 2023

(87) PCT Pub. No.: WO2022/257270
PCT Pub. Date: Dec. 15, 2022

(65) Prior Publication Data

US 2024/0035704 A1 Feb. 1, 2024

(30) Foreign Application Priority Data

Jun. 11, 2021 (CN) ..... 202110652564.3

(51) Int. Cl.
*F24H 3/04* (2022.01)
*F24H 9/00* (2022.01)
*F24H 9/1863* (2022.01)

(52) U.S. Cl.
CPC ..... *F24H 3/0423* (2013.01); *F24H 9/0057* (2013.01); *F24H 9/1863* (2013.01)

(58) Field of Classification Search
CPC ..... F24H 3/04; F24H 3/0423; F24H 9/0052; F24H 9/0057; F24H 9/0063;
(Continued)

(56) References Cited

U.S. PATENT DOCUMENTS 3,610,881 A * 10/1971 Stewart ..... H05B 3/0019 219/400
4,668,855 A * 5/1987 Wilson ..... A45D 20/12 392/385

(Continued)

*Primary Examiner* — Justin C Dodson
(74) *Attorney, Agent, or Firm* — Oliff PLC

(57) ABSTRACT

A heat gun having a flow guiding arrangement, including: a main body in which an air heating element and a hot air tube are provided, the air heating element including a heating core, which includes a mounting bracket and a heating filament, on the mounting bracket being provided a venting cavity and a heating cavity surrounding the venting cavity, the heating filament being provided in the heating cavity, the flow guiding arrangement being disposed at an end of the mounting bracket facing an air outlet of the hot air tube, on the flow guiding arrangement being obliquely arranged a plurality of air guiding passages, the plurality of air guiding passages being disposed about a center of the flow guiding arrangement, inside the hot air tube being further provided a mixing cavity being disposed between the flow guiding arrangement and the air outlet of the hot air tube.

8 Claims, 5 Drawing Sheets

(58) Field of Classification Search
CPC ..... F24H 9/0073; F24H 9/06; F24H 9/1854; F24H 9/1863; H05B 1/0244; H05B 1/0269; H05B 1/0297; H05B 3/02; H05B 2203/022; H05B 2203/03; H05B 2203/033
See application file for complete search history.

(56) References Cited

U.S. PATENT DOCUMENTS

2010/0008655 A1* 1/2010 Tackitt ..... H05B 3/42 392/385
2013/0228232 A1* 9/2013 Chen ..... F24H 9/00 137/335

* cited by examiner

HEAT GUN HAVING FLOW GUIDING ARRANGEMENT

FIELD

The disclosure pertains to the field of power tool, and more particularly relates to a heat gun having a flow guiding arrangement.

BACKGROUND

Heat guns operate to heat inlet air via a heating element and then expel hot air out via a hot air tube. However, in existing heat guns, a heat source is not uniformly distributed on the heating element, such that air passing through various positions of the heating element is heated non-homogeneously, resulting in temperature non-homogeneity of the hot air expelled out through the hot air tube, which deteriorates performance of the heat gun.

SUMMARY

A heat gun having a guide flowing arrangement is provided to solve at least one of the above problems.

Embodiments of the disclosure provide a heat gun having a flow guiding arrangement, comprising: a main body, inside the main body being disposed a heating element configured to generate hot air and a hot air tube from which the hot air generated by the heating element is expelled out, wherein the heating element comprises a heating core disposed in the hot air tube, the heating core comprising a mounting bracket and a heating filament disposed on the mounting bracket, on the mounting bracket being disposed a venting cavity and a heating cavity, the venting cavity and the heating cavity running through the mounting bracket, the heating cavity being disposed surrounding the venting cavity, the heating filament being disposed in the heating cavity, the flow guiding arrangement being disposed at an end of the mounting bracket facing an air outlet of the hot air tube, a plurality of air guiding passages being obliquely provided on the flow guiding arrangement, the plurality of air guiding passages being arranged about a center of the flow guiding arrangement; and a mixing cavity is further provided in the hot air tube, the mixing cavity being disposed between the flow guiding arrangement and the air outlet of the hot air tube.

In the heat gun having a flow guiding arrangement, the flow guiding arrangement comprises a mounting plate mounted on the mounting bracket and a plurality of air bafflers surrounding a peripheral side of the mounting plate, the air bafflers being obliquely arranged such that an air guiding passage is formed between two neighboring air bafflers.

In the heat gun having a flow guiding arrangement, the flow guiding arrangement further comprises a mounting ring disposed concentrically with the mounting plate, an inner wall of the mounting ring being coupled with respective outer peripheral side of the air bafflers.

In the heat gun having a flow guiding arrangement, the flow guiding arrangement comprises a mounting plate mounted on the mounting bracket, ventilation holes being obliquely provided on the mounting plate to form the air guiding passages.

In the heat gun having a flow guiding arrangement, the mounting bracket comprises a central column and a sleeve sleeved outside the central column, the venting cavity running through the central column axially, the heating cavity being formed between the sleeve and the central column.

In the heat gun having a flow guiding arrangement, the flow guiding arrangement is mounted on the central column and has an outer diameter of the flow guiding arrangement being identical to an outer diameter of the central column such that the venting cavity is aligned with the air guiding passages.

In the heat gun having a flow guiding arrangement, a plurality of venting cavities are provided, the plurality of venting cavities being uniformly distributed about a central axis of the central column.

In the heat gun having a flow guiding arrangement, the end of the mounting bracket is provided with at least two superimposed flow guiding arrangements.

In the heat gun having a flow guiding arrangement, a baffle plate is further provided in the mixing cavity, the baffle plate being disposed concentrically with the flow guiding arrangement, an annular air outlet gap being formed between a peripheral side of the baffle plate and an inner wall of the hot air tube.

The Disclosure Offers the Following Benefits:

A heat gun having a flow guiding arrangement, comprising: a main body, inside the main body being disposed a heating element configured to generate hot air and a hot air tube from which the hot air generated by the heating element is expelled out, wherein the heating element comprises a heating core disposed in the hot air tube, the heating core comprising a mounting bracket and a heating filament disposed on the mounting bracket, on the mounting bracket being disposed a venting cavity and a heating cavity, the venting cavity and the heating cavity running through the mounting bracket, the heating cavity being disposed surrounding the venting cavity, the heating filament being disposed in the heating cavity, the flow guiding arrangement being disposed at an end of the mounting bracket facing an air outlet of the hot air tube, a plurality of air guiding passages being obliquely provided on the flow guiding arrangement, the plurality of air guiding passages being arranged about a center of the flow guiding arrangement; and a mixing cavity is further provided in the hot air tube, the mixing cavity being disposed between the flow guiding arrangement and the air outlet of the hot air tube. The technical solution offers the following technical effect:

In the disclosure, air entering the hot air tube is heated by the heating core in the hot air tube; by disposing the flow guiding arrangement at an end of the mounting bracket of the heating core, the hot air flowing through the air guiding passages obliquely disposed on the flow guiding arrangement forms a vortex such that the hot air with higher temperature rise and the hot air with lower temperature rise passing through different parts of the mounting bracket are sufficiently mixed under the action of the vortex, whereby the hot air expelled out of the air outlet of the hot air tube has a more uniform temperature, preventing hot air temperature non-uniformity at different positions of the air outlet of the hot air tube from non-uniformly heating a to-be-heated object, which assure heating effect of the heat gun and enhances user experience.

The flow guiding arrangement comprises a mounting plate mounted on the mounting bracket and a plurality of air bafflers surrounding a peripheral side of the mounting plate, the air bafflers being obliquely arranged such that an air guiding passage is formed between two neighboring air bafflers; the obliquely arranged air bafflers extend the length of the air guiding passages on the flow guiding arrangement, such that only with thin mounting plate and air bafflers, long air guiding passages may be formed, rendering a high spin intensity of the vortex when the hot air flowing through the flow guiding arrangement, whereby the effect of mixing the hot air with higher temperature rise and the hot air with lower temperature rise is enhanced, which assures temperature uniformity of the hot air expelled out of the hot air tube.

The flow guiding arrangement further comprises a mounting ring disposed concentrically with the mounting plate, the inner wall of the mounting ring being coupled with respective outer peripheral side of the air bafflers, respective inner side of the air bafflers being coupled with the outer peripheral side of the mounting plate, such that by securing the inner and outer sides of the air bafflers via the mounting plate and the mounting ring, deformation of the air bafflers such as bend is prevented, which assures shape stability of the air guiding passages, i.e., a vortex may be continuously formed when the hot air flows through the flow guiding arrangement so as to mix the hot air with higher temperature rise and the hot air with lower temperature rise.

The flow guiding arrangement comprises a mounting plate mounted on the mounting bracket, the ventilation holes being obliquely arranged in the mounting plate to form air guiding passages. By providing a plurality of oblique ventilation holes in the mounting plate to form air guiding passages, a simple, firm and wearable structure is formed, thereby extending service life of the flow guiding arrangement.

The outer diameter of the flow guiding arrangement is identical to that of the central column and the flow guiding arrangement is mounted on the central column, whereby the venting cavity is aligned with the air guiding passages; when the heat gun is activated, air enters the hot air tube from the air inlet and flows into the heating cavity and the venting cavity, respectively, wherein the air passing through the heating cavity, which is closer to the heating filament, turns into hot air with higher temperature rise, and the air passing through the venting cavity, which is farther from the heating filament and additionally blocked by the central column, turns into hot air with lower temperature rise; the hot air with lower temperature rise in the venting cavity, after passing through the air guiding passages on the flow guiding arrangement, forms a vortex to mix with the hot air with higher temperature rise at the peripheral side, resulting in hot air with uniform temperature in the mixing cavity, which is then expelled out of the hot air tube, whereby heating effect of the heat gun is assured.

A plurality of venting cavities are provided; the plurality of venting cavities are distributed uniformly along the peripheral direction of the central column, such that the hot air expelled out of respective air guiding passages at the peripheral side of the flow guiding arrangement has a more uniform flow rate.

A mixing cavity is provided in the hot air tube, the mixing cavity being disposed between an end of the heating core and the air outlet of the hot air tube. By disposing the mixing cavity between the end of the heating core and the air outlet of the hot air tube, the hot air is restricted by the wall of the hot air tube, which enhances mixing effect between the hot air with higher temperature rise and the hot air with lower temperature rise.

At least two superimposed flow guiding arrangements are provided at an end of the mounting bracket. By providing a plurality of superimposed flow guiding arrangements, the length of the air guiding passages is extended, whereby the spin intensity of the vortex formed when the hot air flowing through the flow guiding arrangement is enhanced, rendering a better mixing effect between the hot air with higher temperature rise and the hot air with lower temperature rise, which assures temperature uniformity of the hot air expelled out of the hot air tube.

A baffle plate is further provided in the mixing cavity, the baffle plate and the flow guiding arrangement being concentrically arranged, an annular air outlet gap being formed between the peripheral side of the baffle plate and the inner wall of the hot air tube. With arrangement of the baffle plate, which directly blocks the hot air with lower temperature rise in the middle of the mixing cavity from being directly expelled out of the air outlet, the hot air with lower temperature rise, which fails to be mixed with the hot air with higher temperature rise at the peripheral side, is diverted by the baffle plate to flow towards the peripheral side so as to be sufficiently mixed with the hot air with higher temperature rise, and then the mixed hot air is expelled out of the air outlet via the air outlet gap, whereby the heat gun has a more uniform, stable outlet air temperature for the heat gun.

The features and characteristics of the disclosure will be disclosed in the detailed description of the embodiments with reference to the accompanying drawings below.

BRIEF DESCRIPTION OF THE DRAWINGS

Hereinafter, the disclosure will be further described through specific embodiments with reference to the accompanying drawings, wherein.

REFERENCE NUMERALS

Figure 1:
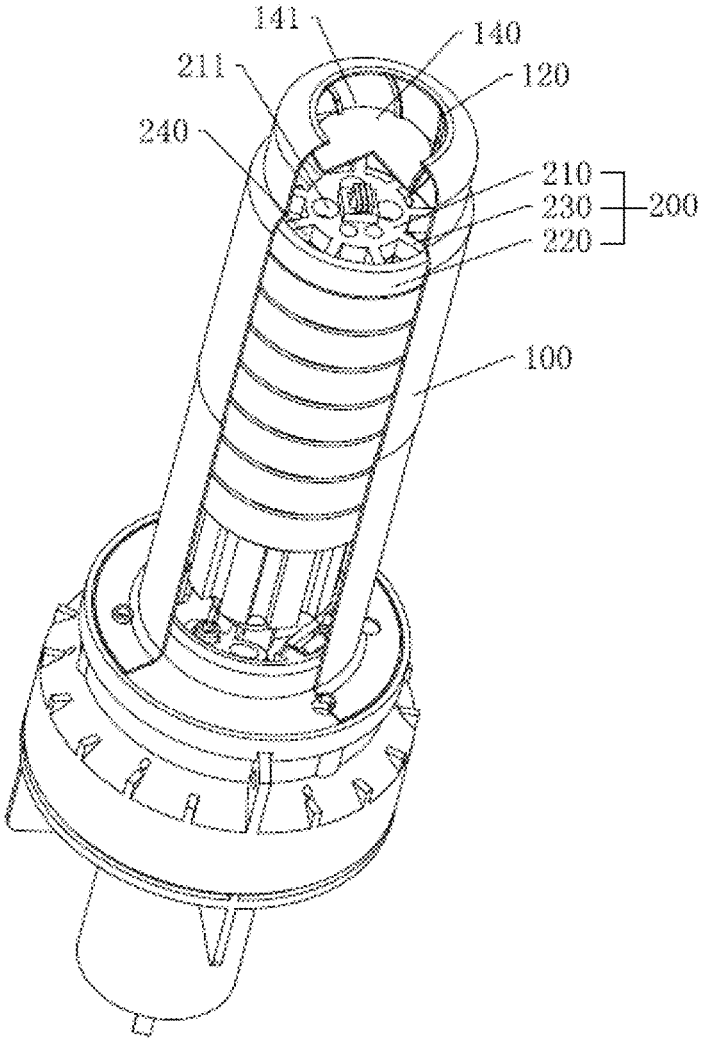
FIG. 1 is a sectional view of a heat gun in a first embodiment, wherein a flow guiding arrangement is not mounted yet.
Figure 2:
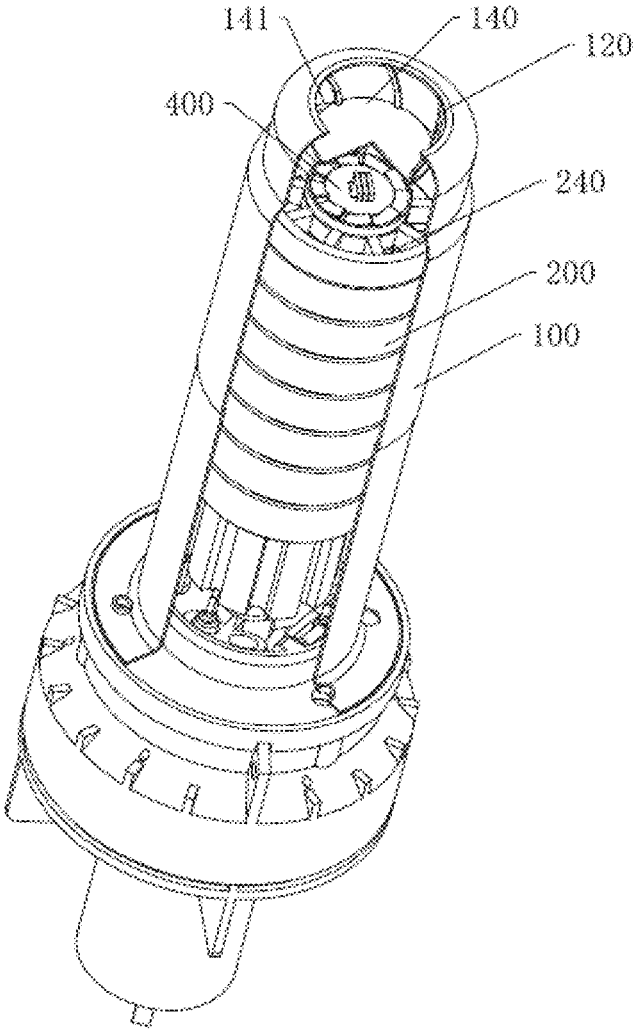
FIG. 2 is a section view of the heat gun in the first embodiment, wherein the flow guiding arrangement is mounted.
Figure 3:
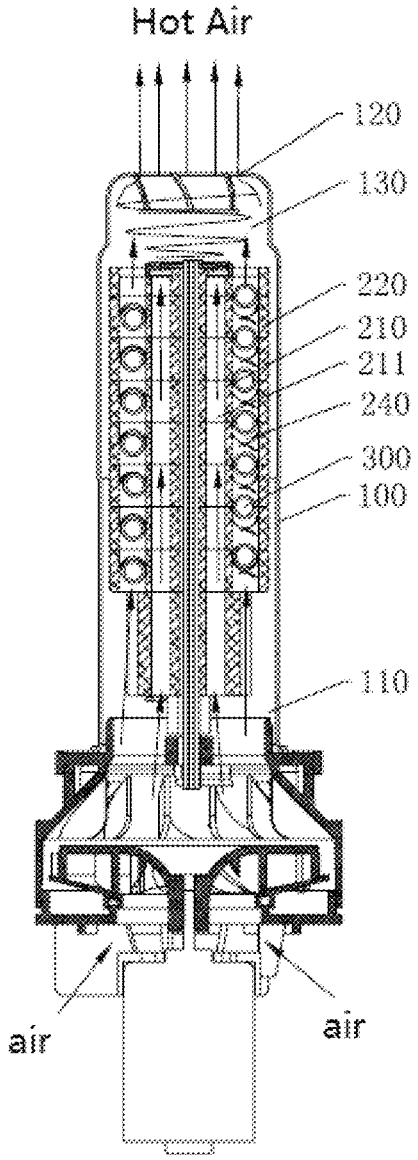
FIG. 3 is a sectional view of the heat gun in the first embodiment.

100. hot air tube;
110. air inlet;
120. air outlet;
130. mixing cavity;
140. baffle plate;
141; air outlet gap;
200. mounting bracket;
210. central column;
211. venting cavity;
220. sleeve;
230. coupler;
240. heating cavity;
300. heating filament;
400. flow guiding arrangement;
410. mounting plate;
420. air baffler;
430. mounting ring;
440. air guiding passage.

DETAILED DESCRIPTION

A heat gun having a flow guiding arrangement is disclosed, which comprises: a main body, inside the main body being disposed a heating element configured to generate hot air and a hot air tube from which the hot air generated by the heating element is expelled out, wherein the heating element comprises a heating core disposed in the hot air tube, the heating core comprising a mounting bracket and a heating filament disposed on the mounting bracket, on the mounting bracket being disposed a venting cavity and a heating cavity, the venting cavity and the heating cavity running through the mounting bracket, the heating cavity being disposed surrounding the venting cavity, the heating filament being disposed in the heating cavity, the flow guiding arrangement being disposed at an end of the mounting bracket facing an air outlet of the hot air tube, a plurality of air guiding passages being obliquely provided on the flow guiding arrangement, the plurality of air guiding passages being arranged about the center of the flow guiding arrangement; a mixing cavity is further provided in the hot air tube, the mixing cavity being disposed between the flow guiding arrangement and the air outlet of the hot air tube. In the disclosure, air entering the hot air tube is heated by the heating core in the hot air tube; by disposing the flow guiding arrangement at an end of the mounting bracket of the heating core, the hot air flowing through the air guiding passages obliquely disposed on the flow guiding arrangement forms a vortex such that the hot air with higher temperature rise and the hot air with lower temperature rise passing through different parts of the mounting bracket are sufficiently mixed under the action of the vortex, whereby the hot air expelled out of the air outlet of the hot air tube has a more uniform temperature, preventing hot air temperature non-uniformity at different positions of the air outlet of the hot air tube from non-uniformly heating a to-be-heated object, which assures heating effect of the heat gun and enhances user experience.

Hereinafter, the technical solution in implementations of the disclosure will be explained and illustrated with reference to the accompanying drawings. However, the implementations below are only preferred ones, not all of them. Based on the exemplary implementations, those skilled in the art may derive other implementations of the disclosure without exercise of inventive work, all of which fall within the protection scope of the disclosure.

In the description of the present disclosure, it needs to be understood that the orientational or positional relationships indicated by the terms "center," "longitudinal," "transverse," "length," "width," "thickness," "upper," "lower," "front," "rear," "left," "right," "vertical," "horizontal," "top," "bottom," "inner," "clockwise," "counterclockwise," etc. are orientational and positional relationships based on the drawings, which are intended only for facilitating description of the present disclosure and simplifying relevant descriptions, not for indicating or implying that the devices or elements compulsorily possess such specific orientations and are compulsorily configured and operated with those specific orientations; therefore, such terms should not be construed as limitations to the present disclosure.

Besides, the terms "first" and "second" are only used for descriptive purposes, which shall not be construed as indicating or implying relative importance or implicitly indicating the quantity of a referred to technical feature. Therefore, the features limited by "first" and "second" may explicitly or implicitly include one or more such features. In the description of the present disclosure, unless otherwise indicated, "plurality" indicates two or above.

In the present disclosure, unless otherwise explicitly provided and limited, the terms such as "mount," "connect," "couple," and "fix" should be understood broadly, which, for example, may refer to a fixed connection, a detachable connection, or an integral connection; which may refer to a mechanical connection or an electrical connection; which may refer to a direct connection or an indirect connection via an intermediate medium; which may also refer to a communication between the insides of two elements. To a person of normal skill in the art, specific meanings of the above terms in the present disclosure may be construed as dependent on specific situations.

In the present disclosure, unless otherwise explicitly provided and limited, an expression that a first element is "above" or "below" a second element may refer to a direct contact between the first element and the second element or may refer to a scenario in which although the first element and the second element do not contact directly, they contact via a further element therebetween. Moreover, the expression that a first element is "above" or "over" or "on" the second element refers to a situation in which the first element is exactly or generally over the second element or only refers to a situation in which the horizontal height of the first element is higher than the second element. The expression that the first element is "under" or "below" or "beneath" the second element refers to a situation in which the first element is exactly or generally below the second element or only refers to a situation in which the horizontal height of the first element is lower than the second element.

First Embodiment

As illustrated in FIGS. 1 to 5, a heat gun having a flow guiding arrangement comprises: a main body, inside the main body being provided a heating element and a hot air tube 100, the heating element being configured to generate hot air, the hot air generated by the heating element being expelled out through the hot air tube 100. The heating element comprises a heating core disposed in the hot air tube 100, the heating core comprising a mounting bracket 200 and a heating filament 300 disposed on the mounting bracket 200, an air inlet 110 and an air outlet 120 being provided at both ends of the hot air tube 100, respectively, wherein the end of the mounting bracket 200 facing the air outlet 120 of the hot air tube 100 is referred to as a front end of the mounting bracket 200, and the opposite end of the mounting bracket 200 is referred to as a rear end of the mounting bracket 200, a flow guiding arrangement 400 inside the hot air tube 100 being disposed at the front end of the mounting bracket 200, a plurality of air guiding passages 440 being obliquely disposed on the flow guiding arrangement 400, the plurality of air guiding passages 440 being arranged about the center of the flow guiding arrangement 400. When the heat gun is activated, air enters from the air inlet 110 of the hot air tube 100 and flows towards the air outlet 120; since a high-temperature heating filament 300 is disposed on the mounting bracket 200, the air passing through the mounting bracket 200 carries the heat produced by the heating filament 300 to turn into hot air; when the air flows through the mounting bracket 200, a fraction of air is closer to the heating filament 300 while another fraction of air is farther from the heating filament 300, such that the air closer to the heating filament 300 turns into hot air with higher temperature rise and the air farther from the heating filament 300 turns into hot air with lower temperature rise; when the hot air flows through the air guiding passages 440 disposed on the flow guiding arrangement 400, the hot air forms a vortex such that the hot air with higher temperature rise and the hot air with lower temperature rise are sufficiently mixed under the action of the vortex, whereby the hot air expelled out through the air outlet 120 of the hot air tube 100 has a more uniform temperature, preventing hot air temperature non-uniformity at different positions of the air outlet 120 of the hot air tube 100 from non-uniformly heating a to-be-heated object, which assures heating effect of the heat gun and enhances user experience.

In the disclosure, the air entering the hot air tube 100 is heated by the heating core in the hot air tube 100, and the flow guiding arrangement 400 disposed at the end of the mounting bracket 200 of the heating core enables the hot air to form a vortex when passing through the obliquely arranged air guiding passages 440 on the flow guiding arrangement 400, such that the hot air with higher temperature rise and the hot air with lower temperature rise flowing through different positions of the mounting bracket 200 are sufficiently mixed, whereby the hot air expelled out through the air outlet 120 of the hot air tube 100 has a more temperature uniformity, preventing hot air temperature non-uniformity at different positions of the air outlet 120 of the hot air tube 100 from non-uniformly heating a to-be-heated object, which assures heating effect of the heat gun and enhances user experience.

Figure 4:
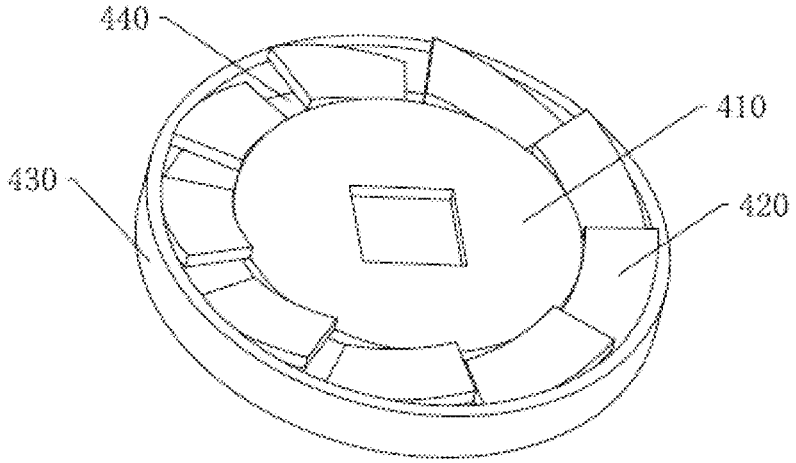
FIG. 4 is a stereoscopic view of the flow guiding arrangement in the first embodiment.
Figure 5:
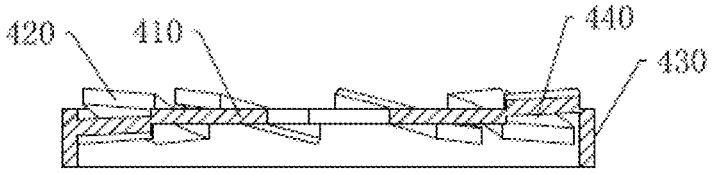
FIG. 5 is a sectional view of the flow guiding arrangement in the first 15 embodiment.

As illustrated in FIG. 4, in this embodiment, the flow guiding arrangement 400 comprises a mounting plate 410 mounted on the mounting bracket 200 and a plurality of air bafflers 420 surrounding a peripheral side of the mounting plate 410, the air bafflers 420 being obliquely arranged towards a same direction along the peripheral tangent line of the mounting plate 410 such that the air guiding passages 440 are formed between two neighboring air bafflers 420. With the obliquely arranged air bafflers 420, the length of the air guiding passages 440 on the flow guiding arrangement 400 is extended, such that only with thin mounting plate 410 and air bafflers 420, longer air guiding passages 440 may be achieved, rendering a high spin intensity of the vortex when the hot air flows through the flow guiding arrangement 400, whereby the mixing effect of the hot air with higher temperature rise and the hot air with low higher temperature rise is enhanced, which assures temperature uniformity of the air expelled out of the hot air tube 100. Of course, it may be appreciated that to further enhance stability of the air bafflers 420, it is preferable in this embodiment that the flow guiding arrangement 400 further comprises a mounting ring 430 disposed concentrically with the mounting plate 410, wherein respective inner side of the air bafflers 420 is coupled with the outer peripheral side of the mounting plate 410, and respective outer side of the air bafflers 420 is coupled with the inner wall of the mounting ring 430, such that by securing the inner and outer sides of the air bafflers 420 via the mounting plate 410 and the mounting ring 430, deformations of the air bafflers 420 such as bend may be prevented, which assures shape stability of the air guiding passages 440, whereby a vortex may be continuously formed to mix the hot air with higher temperature rise and the hot air with lower temperature rise when the hot air flows through the flow guiding arrangement 400.

In this embodiment, the mounting bracket 200 comprises a central column 210 and a sleeve 220 sleeved outside the central column 210, wherein the central column 210 is coupled to via a coupler 230 and disposed concentrically with the sleeve 220; on the central column 210 are provided a plurality of venting cavities 211 running through the central column 210, the venting cavities 211 being parallel with the central axis of the central column 210, and the venting cavities 211 being arranged about the central axis of the central column 210. Of course, it may be appreciated that alternatively, only one venting cavity is provided in this embodiment, whereby the central axis has a tubular shape.

A heating cavity 240 running through the mounting bracket 200 is formed between the sleeve 220 and the outer sidewall of the central column 210, wherein the heating filament 300 is disposed in the heating cavity 240 and wound around the outer side of the central column 210; the flow guiding arrangement 400 is mounted on the central column 210, the outer diameter of the flow guiding arrangement 400 being identical to that of the central column 210 so as to align the venting cavities 211 with the air guiding passages 440. It is preferable in this embodiment that the plurality of venting cavities 211 are uniformly distributed about the central axis of the central column 210, thereby rendering a more uniform flow rate of the hot air expelled out of the respective air guiding passages 440 disposed surrounding a peripheral side of the flow guiding arrangement 400. In this embodiment, a mixing cavity 130 is provided in the hot air tube 100, the mixing cavity 130 being disposed between an end of the heating core and the air outlet 120 of the hot air tube 100, whereby the hot air is restricted by the wall of the hot air tube 100 to enhance the effect of mixing the hot air with lower temperature rise and the hot air with higher temperature rise. Of course, it may be appreciated that the above described are only preferred implementations of this embodiment. In this embodiment, the outer diameter of the flow guiding arrangement 400 may also be identical to that of the sleeve 220 such that the hot air in the venting cavities 211 and the heating cavity 240 may simultaneously flow through the air guiding passages 440 to form a vortex.

When the heat gun is activated, air enters the hot air tube 100 via the air inlet 110 and then flows into the heating cavity 240 and the venting cavities 211, respectively, wherein the air passing through the heating cavity 240, which is closer to the heating filament 300, turns into hot air with higher temperature rise, and the air passing through the venting cavities 211, which is farther from the heating filament 300 and additionally blocked by the central column 210, turns into hot air with lower temperature rise; the hot air with lower temperature rise in the venting cavity 211, after passing through the air guiding passage 440 on the flow guiding arrangement 400, forms a vortex in the mixing cavity 130, while the hot air with higher temperature rise in the heating cavity 240 directly flows into the mixing cavity 130, such that under the action of the vortex, the hot air with lower temperature rise is mixed with the hot air with higher temperature rise at the peripheral side, resulting in mixed hot air with uniform temperature in the mixing cavity 130, which is then expelled out of the hot air tube 100, thereby preventing hot air temperature non-uniformity at different positions of the air outlet 120 of the hot air tube 100 from non-uniformly heating a to-be-heated object, which assures heating effect of the heat gun.

In this embodiment, a baffle plate 140 connected inside the hot air tube 100 is further provided in the mixing cavity 130, wherein the baffle plate 140 and the flow guiding arrangement 400 are concentrically arranged; furthermore, an annular air outlet gap 141 is formed between the peripheral side of the baffle plate 140 and the inner wall of the hot air tube 100. With arrangement of the baffle plate 140, which directly blocks the hot air with lower temperature rise in the middle of the mixing cavity 130 from being directly expelled out of the air outlet 120, the hot air with lower temperature rise in the middle of the mixing cavity 130, which fails to be mixed with the hot air with higher temperature rise at the peripheral side, is diverted by the baffle plate 140 to flow towards the peripheral side so as to be sufficiently mixed with the hot air with higher temperature rise, and then the mixed hot air is expelled out of the air outlet 120 via the air outlet gap 141, thereby rendering a more uniform, stable outlet air temperature for the heat gun.

Second Embodiment

This embodiment differs from the first embodiment in that the flow guiding arrangement in this embodiment comprises a mounting plate mounted on the mounting bracket, ventilation holes being obliquely provided in the mounting plate to form air guiding passages. By providing a plurality of oblique ventilation holes in the mounting plate to form air guiding passages, a simple, firm and wearable structure is formed, thereby extending service life of the flow guiding arrangement. In this embodiment, the ventilation holes may be provided through top and bottom surfaces of the mounting plate, i.e., an air inlet of the ventilation holes is provided on the bottom surface of the mounting plate, and an air outlet of the ventilation holes is provided on the top surface of the mounting plate; of course, it may be understood that the ventilation holes in this embodiment may also be provided through the bottom surface and side surface of the mounting plate, i.e., the air inlet of the ventilation holes is provided on the bottom surface of the mounting plate, and the air outlet of the ventilation holes is provided on the side surface of the mounting plate.

Third Embodiment

Figure 6:
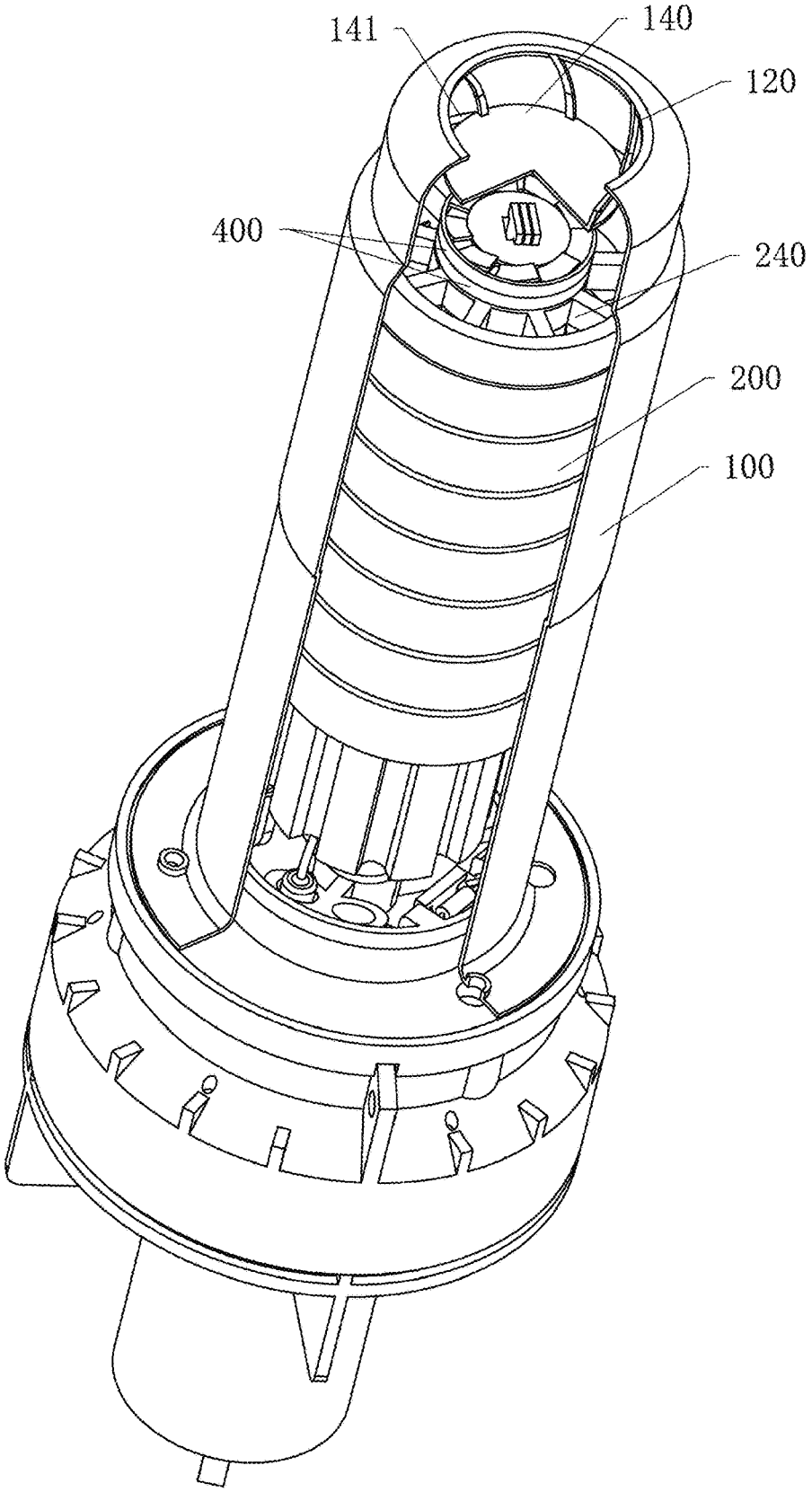
FIG. 6 is a section view of a heat gun in a third embodiment, wherein a plurality of flow guiding arrangements are mounted.

In this embodiment, at least two superimposed flow guiding arrangements 400 are provided at the end of the mounting bracket, as shown in FIG. 6. By providing a plurality of superimposed flow guiding arrangements, the length of air guiding passages increases, which further enhances the spinning intensity of the vortex formed by hot air flowing through the flow guiding arrangements, rendering a better effect of mixing the hot air 20 with higher temperature rise and the hot air with lower temperature rise, further assuring air outlet temperature uniformity of the hot air tube.

What have been described above are only embodiments of the present disclosure; however, the protection scope of the present disclosure is not limited thereto, and all technical solutions covered by the concept of the present disclosure fall within the scope of protection of the present disclosure. It should be noted that for a person of ordinary skill in the art, any modifications without departing from the functions and structural principles of the disclosure will be included within the scope of the present disclosure.

We claim:

1. A heat gun having a flow guiding arrangement, the heat gun comprising:
- a main body,
- a heating element inside the main body, the heating element being configured to generate hot air, and
- a hot air tube from which the hot air generated by the heating element is expelled out, wherein:
- the heating element comprises:
  - a heating core disposed in the hot air tube, the heating core comprising a mounting bracket and a heating filament disposed on the mounting bracket,
  - a venting cavity, and
  - a heating cavity,
- the venting cavity and the heating cavity run through the mounting bracket,
- the heating cavity surrounds the venting cavity,
- the heating filament is in the heating cavity,
- the flow guiding arrangement is at an end of the mounting bracket facing an air outlet of the hot air tube,
- a plurality of air guiding passages are obliquely provided on the flow guiding arrangement, the plurality of air guiding passages being arranged about a center of the flow guiding arrangement,
- a mixing cavity is in the hot air tube, the mixing cavity being disposed between the flow guiding arrangement and the air outlet of the hot air tube,
- the mounting bracket comprises a central column and a sleeve sleeved outside the central column,
- the venting cavity runs through the central column axially,
- the heating cavity is between the sleeve and the central column,
- the venting cavity is aligned with the air guiding passages,
- the heating cavity has an outer diameter that is larger than an outer diameter of the flow guiding arrangement, and
- the air guiding passages are configured to cause a direction of air entering the mixing cavity from the venting cavity to be non-parallel to a direction of air that enters the mixing cavity directly from the heating cavity without come through the air guiding passages.

2. The heat gun having a flow guiding arrangement according to claim 1, wherein the flow guiding arrangement comprises a mounting plate mounted on the mounting bracket and a plurality of air bafflers surrounding a peripheral side of the mounting plate, the air bafflers being obliquely arranged such that each air guiding passage among the plurality of air guide passages is formed between two neighboring air bafflers.

3. The heat gun having a flow guiding arrangement according to claim 2, wherein the flow guiding arrangement further comprises a mounting ring disposed concentrically with the mounting plate, an inner wall of the mounting ring being coupled with respective outer peripheral side of the air bafflers.

4. The heat gun having a flow guiding arrangement according to claim 1, wherein the flow guiding arrangement comprises a mounting plate mounted on the mounting bracket, the the air guiding passages being provided in the mounting plate.

5. The heat gun having a flow guiding arrangement according to claim 1, wherein the flow guiding arrangement is mounted on the central column and has an outer diameter identical to an outer diameter of the central column.

6. The heat gun having a flow guiding arrangement according to claim 5, wherein the venting cavity comprises a plurality of venting cavities, the plurality of venting cavities being uniformly distributed about a central axis of the central column.

7. The heat gun having a flow guiding arrangement according to claim 1, wherein the end of the mounting bracket is provided with at least two superimposed flow guiding arrangements.

8. The heat gun having a flow guiding arrangement according to claim 1, wherein a baffle plate is further provided in the mixing cavity, the baffle plate being disposed concentrically with the flow guiding arrangement, an annular air outlet gap being formed between a peripheral side of the baffle plate and an inner wall of the hot air tube.

* * * * *